United States Patent [19]

Goode

[11] Patent Number: 4,827,861

[45] Date of Patent: May 9, 1989

[54] CABLE RELEASE SYSTEM FOR MARINE CRAFT

[76] Inventor: Gary D. Goode, 110 E. Main St., Ste. #209, Ottawa, Ill. 61350

[21] Appl. No.: 153,955

[22] Filed: Feb. 9, 1988

[51] Int. Cl.[4] ..... B63B 21/04; B66C 1/38

[52] U.S. Cl. ..... 114/251; 114/252; 294/82.33

[58] Field of Search ..... 294/82.27, 82.3, 82.33, 294/82.31; 114/253, 252, 242, 249, 251; 24/241 SP, 241 P

[56] References Cited

U.S. PATENT DOCUMENTS

| | | | |
|---|---|---|---|
| 2,868,581 | 1/1959 | Minty | 294/82.33 |
| 4,034,992 | 7/1977 | Epstein | 294/82.33 |
| 4,587,920 | 5/1986 | Thompson | 114/252 |
| 4,611,842 | 9/1986 | Epstein | 294/82.33 |

*Primary Examiner*—Joseph F. Peters, Jr.
*Assistant Examiner*—Edwin L. Swinehart
*Attorney, Agent, or Firm*—J. Peppers

[57] ABSTRACT

A towing system adapted for quick and safe release of a towing tug from a barge string. Cable cleats and bits are mounted on the tug and on the barge string to position and support a cable which is connected into a winch apparatus to tightly connect the tug and the barge string together. A cable loop is looped around and retained by a cable retainer arm pivotably connected into a frame mounted to retain the cable. The retainer arm forms a distal finger retained to latch the arm into cable retaining position by a latch lock device. The latch lock device is pivotably mounted in the frame to retain the distal finger. A catch device forming a catch hook is pivotably mounted to the latch block device. A retainer bar is fixably mounted with the frame to engage the catch hook for keeping the latch block in position to retain the finger. A lever arrangement is pivotably connected to the frame for pushing the catch hook free of the retainer bar device. The catch releases the latch block, the latch block then moves to release the finger, the finger then moves with the retainer arm to free the cable. The lever arrangement is actuated to push the latch hook off the latch bar in response to a remotely actuated electrical solenoid device.

20 Claims, 2 Drawing Sheets

CABLE RELEASE SYSTEM FOR MARINE CRAFT

FIELD OF THE INVENTION

This invention generally relates to wire cable connections for marine vessels and more particularly pertains to such systems including quick cable release apparatus.

BACKGROUND OF THE INVENTION

Tow or tug boats are securely connected to other marine vessels, such as barges, ships or boats to propel such marine vessels through waterways or to and from harbour docks. The waterways may be rivers, canals and the like. These tow tugs are generally connected to the propelled vessels with high strength steel cable which is pulled into very high tension for secure connection, particularly when a tow tug is connected to push a group of barges connected together into a "string" or "tow", for example. In these pushing arrangements the tow tugs serve both to propel the barge string and also to serve as the "rudder" for the barge string as it is pushed along.

The individual cable tension employed to securely connect a tug/barge string combination can be as much as 60,000 lbs., for example. When a cable under high tension is suddenly disconnected, the free end of the cable whips and lashes about with great velocity. Such disconnection must be made with crew members safely out of the way. Also, the towing tug sometimes must be quickly disconnected from the barge string due to navigational contingencies. Due to tidal currents and the like, a ship tied up at a dock must be released from mooring cables under high tensional stress at times.

The present invention permits remotely actuated quick disconnection of cables from a safe distance with the reaction time to release the cable being minimal.

Presently known prior art for this invention consists of U.S. Pat. Nos. 37,681, 678,798, 1,417,222, 1,462,102, 1,458,404, 2,485,416, 3,811,720, 3,831,486, 3,892,196, 4,034,992, 4,233,923, 4,389,907, 4,540,210, and 4,618,179. Specifically, the present invention is in improvement to release mechanisms and systems as disclosed in Pat. No. 4,540,210.

OBJECTS OF THE INVENTION

An object of this invention is to provide a cable release system which may be remotely operated from the wheel house of a tow tug, for example, with optimum response time.

Another object of this invention is to provide a cable quick release system wherein the cable may be disconnected at any time while under great tension without danger to crew personnel.

Another object of the present invention is to provide cable disconnect apparatus which may be simply installed at a modest cost as a retro-fit on present towing vessels.

A further object of the present invention is to provide cable disconnect apparatus which may be formed largely of steel or malleable iron castings with little finish machining necessary; with standard steel pins, bolts and fasteners; and with a readily available electrical solenoid actuator.

SUMMARY OF THE INVENTION

The foregoing and other objects of the invention are attained in a towing system adapted for quick and safe release of a towing tug from a barge string. At least one cable connects the barge string to the towing tug. Cable cleats and bits are mounted on the tug and on the barge string to position and support the cable. The cable has a first end connected into a winch apparatus and a second end forming a cable loop. The winch is mounted for drawing the cable as guided by the cleats to tightly connect the tug and the barge string together. The cable loop is looped around and retained by a cable retainer arm pivotably connected into a frame mounted to retain the cable as the cable is drawn tight by the winch. The retainer arm is adapted to pivot from a cable retaining position to a cable release position responsive to tension imposed in the cable. The retainer arm forms a distal finger retained to latch the arm into cable retaining position by a latch lock device. The latch lock device is pivotably mounted in the frame to retain the distal finger while in a first position and to release the finger when moved to a second position. A catch device forming a catch hook is pivotably mounted to the latch block device. A retainer bar is fixably mounted with the frame to engage the catch hook for keeping the latch block in position to retain the finger. A lever arrangement is pivotably connected to the frame for pushing the catch hook free of the retainer bar device when moved from a first to a second position. The catch releases the latch block, the latch block then moves to release the finger, the finger then moves with the retainer arm to free the cable. The lever arrangement is actuated to push the latch hook off the latch bar in response to a remotely actuated electrical solenoid device. The lever arrangement may be manually actuated to push the latch block free of the retainer bar. The support arm includes a support saddle formed to support the cable loop while retained by the retainer arm.

The catch forms a lever which is engaged by the retainer arm when the arm is brought into cable retaining position while the catch device is in unlatched position to move the catch hook to rehook the catch hook on the retainer bar as the latch lock device is moved into its arm retaining position.

The towing tug is connected to the barge string by at least one cable arrangement provided on each side of the tug. The pivot axis of the retainer arm is a designated distance from the axis of the cable while the cable is in tension whereby the cable tension imposes force to urge the arm against the latch block to rapidly pivot the arm to release the cable when the finger is released by the latch block.

DESCRIPTION OF A PREFERRED EMBODIMENT

Figure 1:
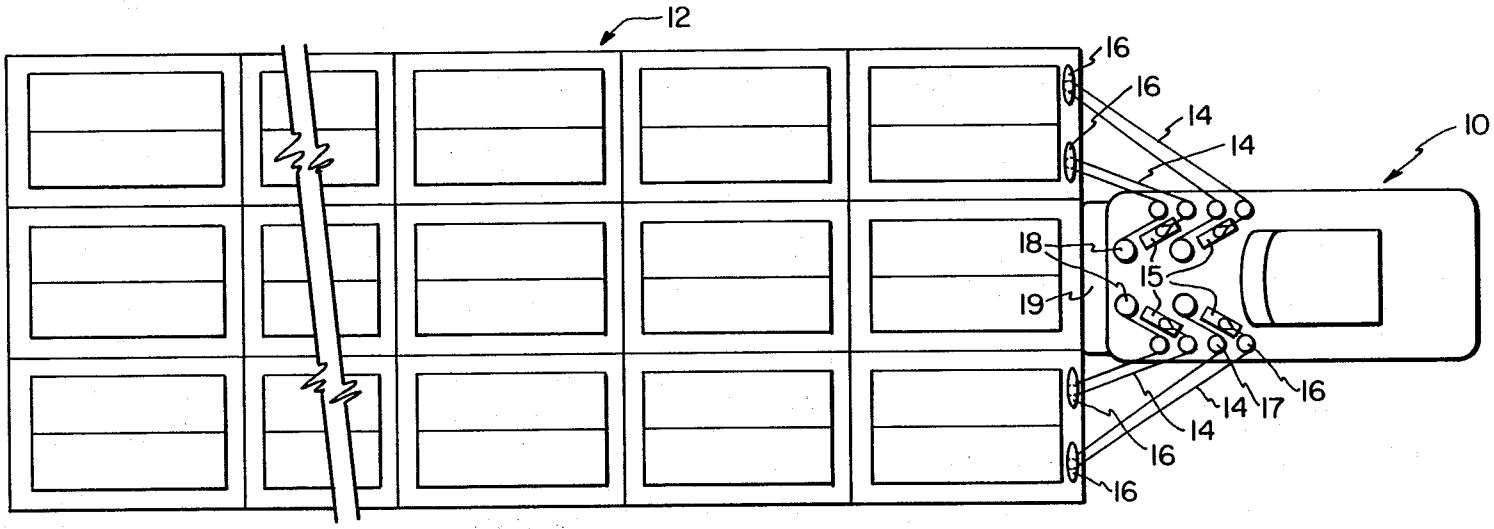
FIG. 1 is a plan view, partly schematic, of a towing tug tightly connected to a barge string by a plurality of steel cables appropriately guided through cleats or bits as shown.

Turning now to FIG. 1, there is shown a typical towing tug/barge string combination as moving along waterways such as the Inter Coastal Canal or the Mississippi River, for example.

As seen, the tug 10 is connected to a barge string 12 by a plurality of cables 14 guided around suitable cleats 16 located on the barges and on the tug. On the tug 10, each cable 14 is guided through a guiding cleat 16 to be fastened to a release apparatus 15. Cable 14 is also guided through a bit 17 into an electrical winch 18 where the cable is usually drawn as tightly as each winch 18 is able to tighten the cable.

Shown schematically on the bow of the barge 10 is a bumper or mat 19. The combination of the cables 14 and the mat 19 provides a connection which is relatively rigid laterally yet flexible horizontally. When the tug 10 is connected to the barge string 12 as shown, the tug serves both to propel the barge string and to act as rudder to the barge string in guiding it through a waterway.

Figure 2:
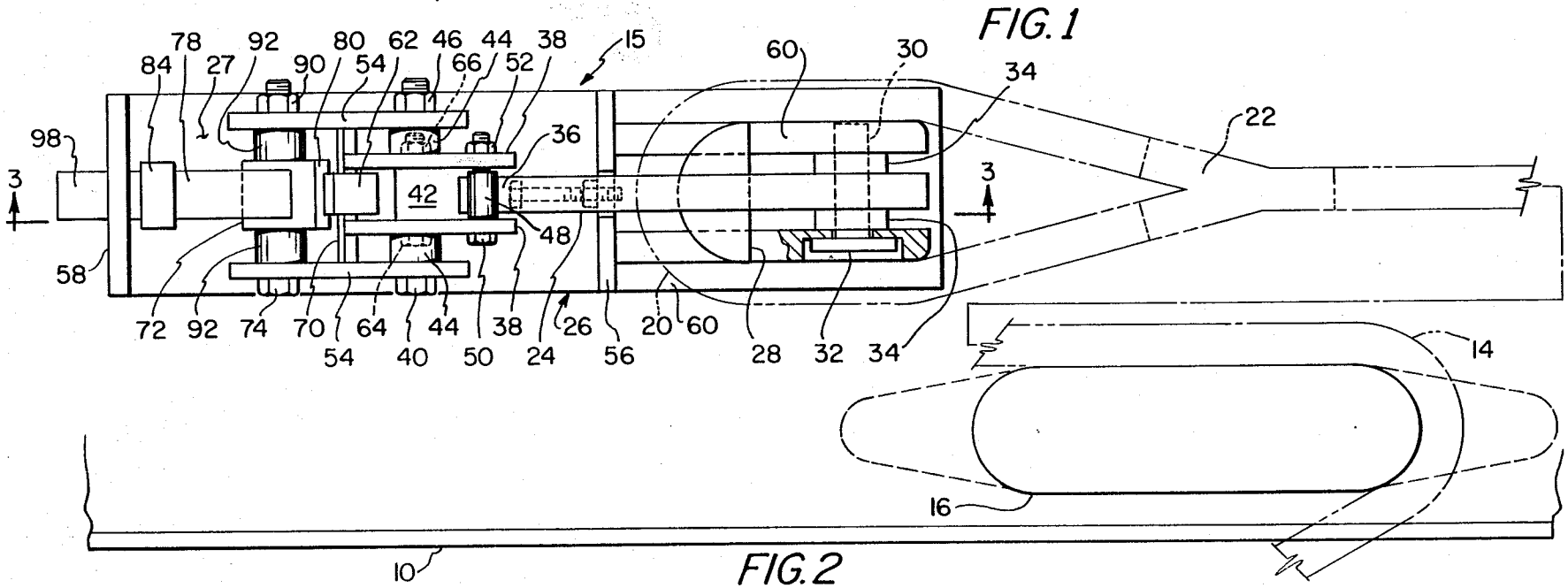
FIG. 2 is an enlarged plan view, partly schematic, of a quick cable release apparatus mounted on the port side of the towing tug.
Figure 3:
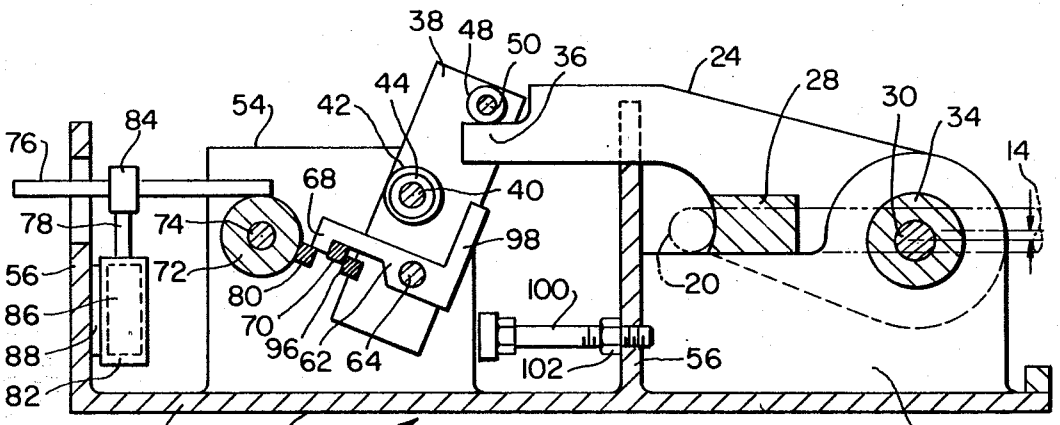
FIG. 3 is a partly sectional side elevation of the apparatus of FIG. 2 as taken along the lines 3-3 and showing the apparatus retaining a cable in latched position.
Figure 5:
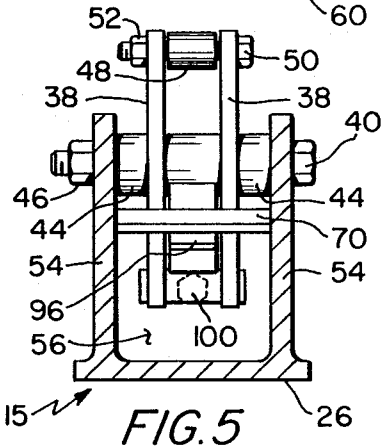
FIG. 5 is a cross sectional view of the apparatus taken along the lines 5—5 of FIG. 4.

As further shown in FIGS. 2 and 3, the cable 14 extends from the release apparatus 15 around a deck guiding cleat 16 and thereon to an appropriate guiding cleat 16 on the barge string. Cable 14 terminates as shown with a cable loop 20 spliced into the cable through a splice sleeve 22.

The principal component of the release apparatus 15 is a frame 26 having a frame base 27 which is connected to the deck and framework of the barge 10 by fastener means (not shown) such as bolts or welding. Mounted in pivoted relation within frame 26 is a cable retainer arm 24 which may form a grooved radial seat 28 in which the cable loop 20 is seated while connected. The retainer arm 24 is pivotably connected to the frame 26 through a pivoted retainer pin 30 which extends through bolster members 60 and retained by tack welding of a retainer plate 32 or snap rings, for example (not shown). The retainer arm 24 is spaced appropriately between the retainer bolster members 60 by means of spacer washers 34.

The retainer arm 24 forms a pivotal latching finger 36 which extends through a support buttress 56 to be retained by a latch roller sleeve 48, as later described.

Latch bars 38 are pivotably mounted about a pivot bolt 40 which extends through the latch bars and through side plates 54 to be retained by a threaded retainer nut 46. The latch bars are appropriately spaced on either side by spacer sleeves 44 and a catch link stop sleeve 42 as shown in FIGS. 2 and 3.

The latch sleeve or roller 48 is mounted between the latch bars 38 by means of a latch roller bolt 50 retained with a threaded nut 52. The support buttress 56, the side plates 54 and an end buttress 58 together with frame base 27 are integrally formed to constitute the frame 26. The frame 26 may be a steel or malleable iron casting, for example.

A catch link 62 is pivotably mounted between the latch bars 38 by means of a bolt 64 extending through latch bars 38 and the catch link 62 and retained by a threaded retainer nut 66. Formed on the swinging end of latch catch link 62 is a catch hook 68 which is adapted to fit down over and be retained by a stationary catch hook retainer bar 70 which extends between the side plates 54.

A catch release arrangement including a pivoted catch release body 72, a catch release lug 80 and a catch release lever 76 is pivotably mounted between the side plates 54 by means of a bolt 74 retained by a threaded retainer nut 90 and spaced appropriately with catch release spacers 92 as shown.

Figure 4:
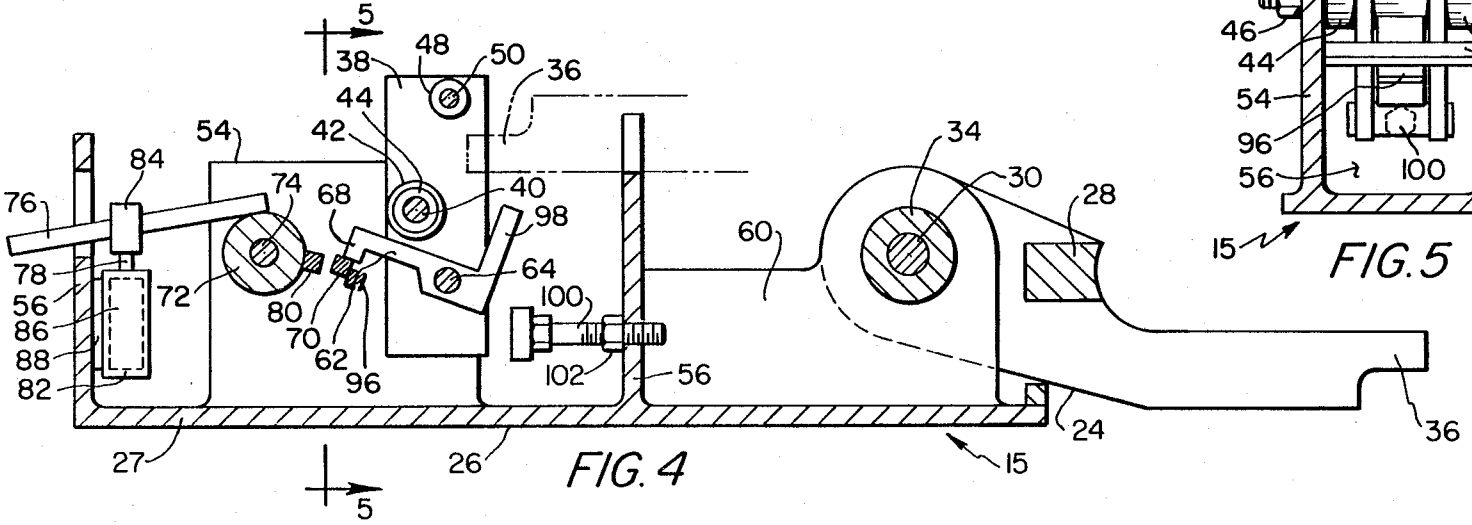
FIG. 4 is the same view as FIG. 3 but showing the same apparatus in disconnect position with the cable released.

As best shown in FIGS. 3 and 4, the catch release body 72 is adapted to be pivoted or rotated by means of the lever 76 and thereby to move the lug 80 upwardly into contact with the hook 68 of the catch link 62 and then to push the catch hook 68 off of retaining engagement with the catch hook retainer bar 70. It is seen that manual movement of the lever 76 would effect the disconnection of hook 68 from the retainer bar 70 through movement of the lug 80.

Preferably, however, the lever bar is adapted to be moved downwardly by means of a solenoid 82 mounted to the buttress 58 by a bracket 88. The solenoid 82 includes a solenoid shaft rod 78 which extends into a clevis 84 and around the lever 76. The clevis 84 is adjusted downwardly on rod 78 by means of a threaded connection on the shaft 78 such that stroking of the solenoid 82 rotates the release body 72 sufficiently to cause the lug 80 to disconnect hook 68 from support bar 70.

The solenoid 82 may be activated by a signal voltage applied through a control wire (not shown) from about any safe position on tug 10, such as the wheel house. A suitable solenoid 82 (having a return spring 86 as shown) is available from Trombetta Corporation, 1633 East North Avenue, Milwaukee, Wis. 53202.

As shown in FIG. 3, the axis of the cable 14 is offset from the center line of the pivot pin 30 such that the tensional force on the cable 14 is translated into a tangential force on the arm 24 with resulting upward force on the finger 36 where retained by the roller sleeve 48. In turn, the upward force from finger 36 is translated through roller 48 and bolt 50 into a tangential force onto latch bars 38.

The force on latch bar 38 is pivoted about the bolt 40 into a tangential force on the pin on bolt 64 and the catch 1ink 62. The catch link 62 is restrained from movement by such tangential force by the abutment of the hook 68 against the retainer bar 70. The frictional force necessary to push the hook 68 off the retainer bar 70 is supplied by the lever 76 which rotates with body 72 about bolt 74 to lug 80 against the hook 68.

The geometry of the centers of pin 30, cable 14, latch bolt 50, latch pivot bolt 40, catch bolt 64, and the leverage provided by the link of catch link 62 to hook 68 may be provided by one skilled in the art such that a 60,000 lb. pull on cable 14 will be resolved into a force of 50 lbs., for example, to push latch 68 off of retainer bar 70. The 50 lb. force is further resolved to 10 lbs., for example, necessary for the solenoid rod 78 threaded to clevis 84 to pull the lever 76 down and thereby cause the release lug 80 to push the hook 68 off the retainer bar 70.

Further, as shown in FIG. 3, there is no tendency for hook 68 to slide off the retainer bar 70 since some tangential force may be generated in the catch link 62 to retain the hook 68 on the retainer bar 70 in addition to the friction caused by such abutment. The abutting flat surfaces of the hook retainer bar 70 and the catch link hook 68 are tangential to some radius between such surfaces and the center of the link bolt 64. Thus, the geometry of the catch link 62 may be provided to create a tangential force between the surfaces of hook 68 and the retainer bar 70 as caused by the force imposed on bolt 64 by the latch bars 38 during he time that latch roller sleeve 48 is retaining finger 36 of the arm 24.

Figure 6:
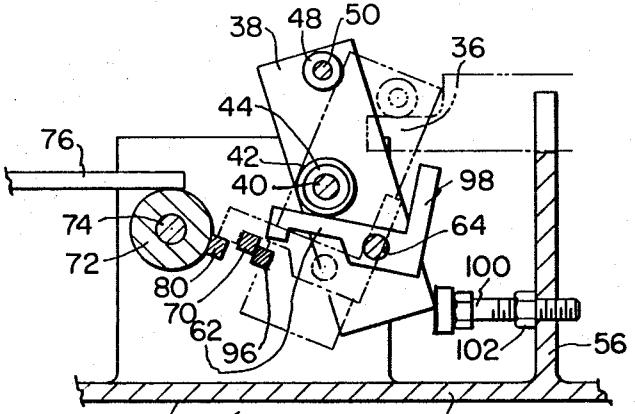
FIG. 6 is a further sequence of FIG. 4 and showing linkage movement as the apparatus is relatched to the position shown in FIG. 3.

The invention further provides a convenient latching arrangement when a cable loop 20 is brought in to be latched and the arm 24 is pivoted over to the positions shown in dashed lines in FIG. 6. As also shown in FIG. 6, the latch link 62 forms a reset lever 98 which engages arm 24 as it moves into position. The latch link 62 has been set at its position as shown by a catch link stop 96 welded to retainer bar 70 in a "stepped down" position as shown.

The stop bolt 100 stops the rotation of latch bar 38 as it is being released. As the cable 20 is being released the latch bar 38 is stopped from rotation by the stop bolt assembly 100. When latch 38 is stopped the inertia of link 62 causes link 62 to pivot until stopped by catch link stop 96 which is attached to retainer bar 70. Catch link 62 remains retained by link stop 96 until the apparatus is reset in the cable retaining position shown in FIGS. 2 and 3. Stop bolt 100 is threaded into buttress 56 and adjustably locked by lock nut 102.

As arm 24 is pivoted down against a lever 98, the lever moves and pivots latch link 62 to a position where the hook 68 clears the retainer bar 70. The latch links 38 are pivoted to move roller 48 over finger 36 until the pivoting movement is stopped by latch bars 38 striking the retainer bar 70. When the pivoting movement stops the hook 68 of 1ink 62 is dropped into engagement with retainer bar 70, as shown.

OPERATION OF THE PREFERRED EMBODIMENT

In operation, the tug 10 is moved into position with respect to the barge string 12 as shown in FIG. 1 and the cables 14 are paid out of the winches 18 around the cleats 16 and bits 17 to the individual cable release devices 15. As shown in FIGS. 2 and 3, the loop 20 of each cable 14 is closed in by the arm 24 into seating position on a respective radial seat 28. The latch bars 38 are rotated to move the latch roller sleeve 48 into engaged position to retain the finger 36. The catch link 62 is moved to bring the catch hook 68 down over into latched position on the hook retainer bar 70. The spring 86 has previously positioned the lever 76 into the position shown in FIG. 3. Each winch 18 is then actuated to draw each cable 14 into high tension to position the towing tug 10 firmly with the barge string 12 as shown in FIG. 1. In actual practice the winches 18 are generally drawn to maximum capacity to tighten the cables 14 as far as practicable. The tension in each cable 14 may be as much as 60,000 lbs., for example.

At such time as it becomes desirable to disengage the cables 14 between the tug 10 to the barge string 12 as shown in FIG. 1, the solenoid 82 as shown in FIGS. 3 and 4 may be actuated remotely, as from the wheel house of the tug 10. Actuation of the solenoid 82 draws the lever 76 down and brings the lug 80 around to push the hook 68 off the retainer bar 70. Release of the catch link 62 permits the upward force as exerted by finger 36 to cause the roller sleeve 48 to roll off the finger 36 as permitted by the released latch bar 38. Once the finger 36 is released from roller 48 the arm 24 is abruptly pivoted around to the position shown in FIG. 4 and the released cable 14 whips free of the cleat 16, permitting very rapid disengagement of the tug 10 from the barge string 12. The cables 14 then may be pulled free of the cleats 16 of the barge string and brought back aboard the tug 10 by the winches 18.

It is to be noted that the release of each of the release devices 15 are virtually instantaneous and may be remotely controlled from the wheel house of the tug 10 without the necessity of any person being in the vicinity of cables 14 which invariably whip and lash about when released from high tension.

When it is desired to relatch a cable loop 20 into release apparatus 15, the cable is brought in slack and the arm 24 is pivoted around to latchable position with loop 20 resting in radial seat 28. The spring 86 has restored lever 76 and lug 80 to the position shown in FIG. 3. The latch links 38 are then moved manually to place the latching roller 48 over the finger 36. The movement of arm 24 and latch links 38 cause the reset lever 98 to lift the hook 68 over retainer bar 70. Tension then applied to cable 14 and loop 20 tightens up the slack and the release apparatus is again ready to suddenly release cable responsive to application of an electrical voltage to solenoid 82.

It is to be noted that the single embodiment disclosed and described herein may be modified and changed considerably without departing from the spirit of the invention or from the scope and purview of the appended claims.

I claim:

1. A towing system adapted for quick and safe release of a towing tug from a barge string, comprising:

(a) a plurality of barges affixed together to form a barge string;

(b) a towing tug for moving said barge string;

(c) at least one cable connecting said barge string to said tug;

(d) cable guiding cleat means mounted on said tug and said barge string to position and support said cable;

(e) said cable having a first end connected into winch means and a second end forming a cable loop;

(f) said winch means being mounted for drawing said cable as guided by said guiding cleat means to tightly connect said tug and said barge string together;

(g) said cable loop being looped around and retained by a cable retainer arm pivotably connected into a frame mounted to retain said cable as said cable is drawn tight by said winch means;

(h) said retainer arm being adapted to pivot from a cable retaining position to a cable release position responsive to tension imposed in said cable;

(i) said retainer arm forming a distal finger retained to latch said arm in cable retaining position by a latch block means;

(j) said latch block means being pivotably mounted in said frame to retain said distal finger while in a first position and to release said finger when pivoted to a second position;

(k) a catch means having a catch hook means pivotably mounted to said latch block means;

(l) a retainer bar means fixedly mounted with said frame to engage said catch hook means for keeping said latch block in position to retain said finger; and (m) lever means pivotably mounted to said frame for pushing said catch hook means free of said retainer bar means to release said catch means;

(n) said catch means releasing said latch block, said latch block then moving to release said finger, said finger then moving with said retainer arm to free said cable.

2. The system of claim 1 wherein said lever means is actuated to push said latch hook by remotely actuated electrical solenoid means.

3. The system of claim 1 further including reset lever means connected with said catch means to move responsive to pivoting movement of said arm into cable retaining position along with pivoting movement of said latch block means to move said catch hook means into hooked position with said retainer bar means.

4. The system of claim 3 further including a support saddle means formed to support said cable loop while retained by said retainer arm.

5. The system of claim 2 wherein said tug is connected to said barge by at least one said cable provided on each side of said tug.

6. The system of claim 2 further including a saddle means formed with said retainer arm to support said cable loop while said cable loop is retained by said retainer arm.

7. The system of claim 1 wherein the pivot axis of said retainer arm is located a designated distance from the axis of said cable while said cable is in tension for imposing force to urge said arm against said latch block means to rapidly pivot said arm to release said cable when said finger is released by said latch block means.

8. A cable quick release system, comprising:

(a) a cable connecting two bodies together with said cable being in tension;

(b) said cable having a first end connected into tensioning means for applying tension and a second end forming a cable loop;

(c) said cable loop being looped around and retained by a cable retainer arm pivotably connected into a frame mounted to retain said cable as said cable is drawn tight by said tensioning means;

(d) said retainer arm being urged to pivot from a cable retaining position to a cable release position responsive to tension imposed in said cable;

(e) said retainer arm forming a finger retained to latch said arm into cable retaining position by latch block means;

(f) said latch block means being mounted into said frame to retain said finger while in a first position and being urged by cable tension to be pivoted to a second position for releasing said finger;

(g) a catch means having a catch hook means pivotably mounted to said latch block means;

(h) a retainer bar means fixedly mounted with said frame to engage said catch hook means for keeping said latch block in position to retain said finger; and (i) lever means pivotably connected to said frame for pushing said catch hook means free of said retainer bar means when moved from a first to a second position;

9. The system of claim 8 wherein said lever means is actuated to push said latch hook by remotely actuated electrical solenoid means.

10. The system of claim 8 further including reset lever means connected with said catch means to move responsive to pivoting movement of said arm into cable retaining position along with pivoting movement of said latch block means to move said catch hook means into hooked position with said retainer bar means.

11. The system of claim 10 further including a saddle means formed with said retainer arm to support said cable loop which while said cable loop is retained by said retainer arm.

12. The system of claim 11 wherein the pivot axis of said retainer arm is a designated distance from the axis of said cable while said cable is in tension for imposing force to urge said arm against said cable latch block means to rapidly pivot said arm to release said cable when said finger is released by said latch block means; and wherein a tow tug is connected to a barge string by at least one said cable provided on each side of said tug.

13. A cable quick release apparatus; comprising:

(a) a cable retainer arm adapted to receive and retain a cable loop and mounted to retain said cable loop as the cable is pulled tight;

(b) said retainer arm adapted to be urged to pivot from a cable retaining position to a cable release position responsive to tension imposed in said cable;

(c) said retainer arm forming a distal finger retained to latch said arm into cable retaining position by a latch block means;

(d) said latch block means being pivotably mounted with said frame to retain said distal finger while in a first position and while adapted to be urged by cable tension to be pivoted to a second position for releasing said finger;

(e) a catch means having a catch hook means pivotably mounted to said latch block means;

(f) a retainer bar means fixedly mounted with said frame to engage said catch hook means for keeping said latch block in position to retain said finger; and (g) lever arm means pivotably connected to said frame for pushing said catch hook means free of said retainer bar means for releasing said catch means when moved from a first to a second position;

(h) said catch means releasing said latch block, said latch block then moving to release said finger, said finger then moving with said retainer arm to free said cable.

14. The system of claim 13 wherein said lever means is actuated to push said latch hook by remotely actuated electrical solenoid means.

15. The system of claim 14 further including reset lever means connected with said catch means to move responsive to pivoting movement of said arm into cable retaining position along with pivoting movement of said latch block means to move said catch hook means into hooked position with said retainer bar means.

16. The system of claim 15 further including a support saddle means formed to support said cable loop while retained by said retainer arm.

17. The apparatus for claim 14 wherein a towing tug is connected to a barge string by at least one said cable release apparatus connected into a respective said cable loop on each side of said tug.

18. The system of claim 14 further including a saddle means formed with said retainer arm to support said cable loop while said cable loop is retained by said retainer arm.

19. The apparatus of claim 15 wherein the pivot axis of said retainer arm is a designated distance from the axis of said cable while said cable is in tension for imposing force to urge said arm against said latch block means to rapidly pivot said arm to release said cable when said finger is released by said latch block means.

20. The apparatus of claim 17 wherein said solenoid means is actuated from a wheel house of said towing tug.

* * * * *